US005661858A

United States Patent [19]

House et al.

[11] Patent Number: 5,661,858

[45] Date of Patent: Sep. 2, 1997

[54] COMPACT POWERED LIFT TOILET SEAT

[76] Inventors: Edward L. House, 1305 Briar Dr., Batesville, Ark. 72501; Johnny White, 411 Main, Newport, Ark. 72112; Howard L. House, 1775 Highland Rd., Batesville, Ark. 72501; Greg Dollins, 303 W. Center, Apt. 12, Searcy, Ark. 72143; Ronald Lucy, P.O. Drawer 2236, Batesville, Ark. 72503

[21] Appl. No.: 691,518

[22] Filed: Aug. 2, 1996

[51] Int. Cl.[6] ..... A47K 13/10

[52] U.S. Cl. ..... 4/667; 4/246.1; 4/246.3; 297/DIG. 10

[58] Field of Search ..... 4/667, 560.1, 561.1, 4/562.1, 563.1, 246.1, 246.3; 297/DIG. 10, 327, 330, 337

[56] References Cited

U.S. PATENT DOCUMENTS

| | | | |
|---|---|---|---|
| 1,399,744 | 12/1921 | Brophy | 4/251 |
| 2,869,623 | 1/1959 | Poulin | 155/198 |
| 3,473,174 | 10/1969 | Cool | 4/251 |
| 3,925,833 | 12/1975 | Hunter | 4/251 |
| 4,185,335 | 1/1980 | Alvis | 4/251 |
| 4,581,778 | 4/1986 | Pontoppidan | 4/251 |
| 4,587,678 | 5/1986 | Love et al. | 4/251 |
| 4,833,736 | 5/1989 | Sadler et al. | 4/251 |
| 4,884,841 | 12/1989 | Holley | 297/331 |
| 4,907,303 | 3/1990 | Baird | 4/480 |
| 4,949,408 | 8/1990 | Trkla | 5/86 |
| 4,993,085 | 2/1991 | Gibbons | 4/251 |
| 5,142,709 | 9/1992 | McGuire | 4/607 |
| 5,155,873 | 10/1992 | Bridges | 4/667 |
| 5,189,739 | 3/1993 | Thierry | 4/254 |
| 5,309,583 | 5/1994 | White et al. | 4/667 |
| 5,323,497 | 6/1994 | Lih et al. | 4/667 |
| 5,333,931 | 8/1994 | Weddendorf | 297/DIG. 10 |

FOREIGN PATENT DOCUMENTS

| | | |
|---|---|---|
| 1554583 | 6/1966 | Germany . |
| 2625046 | 12/1977 | Germany . |

*Primary Examiner*—David J. Walczak
*Attorney, Agent, or Firm*—Ray F. Cox, Jr.

[57] ABSTRACT

A compact powered lift toilet for assisting a person in rising from or being seated upon a toilet by duplicating the natural motions of the human body. The toilet set accomplishes three separate motions simultaneously: (1) vertical translation, (2) horizontal translation, and (3) rotation. A sun and planet gear mechanism lifts and moves forward the front of the toilet seat while a lever action on the rear of the toilet seat causes the rear of the seat to rise and tilt forward with respect to the front of the seat. Both the sun and planet gear and the rear lever action are effected by a single linear actuator.

1 Claim, 7 Drawing Sheets

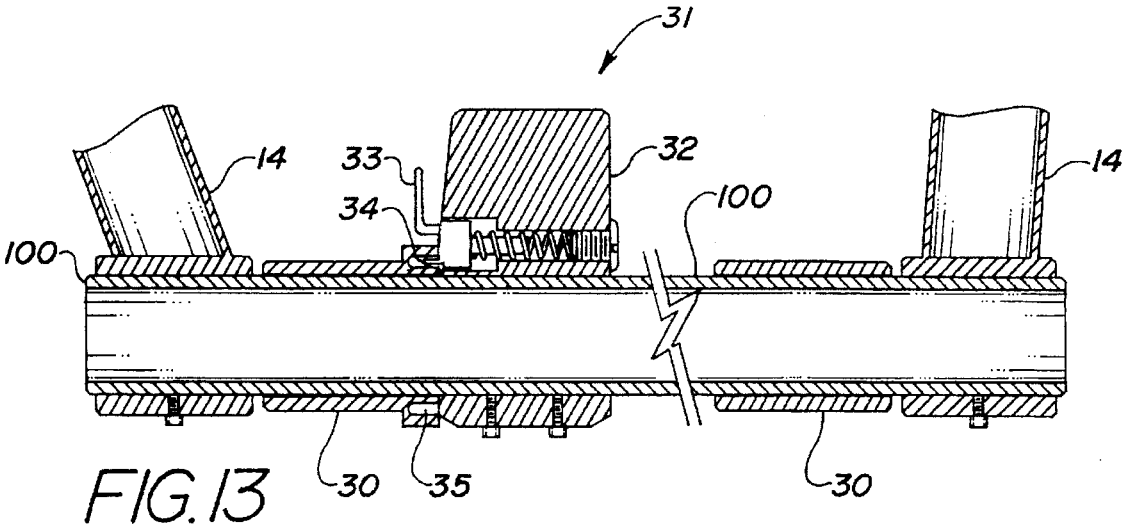
FIG. 13
FIG. 14
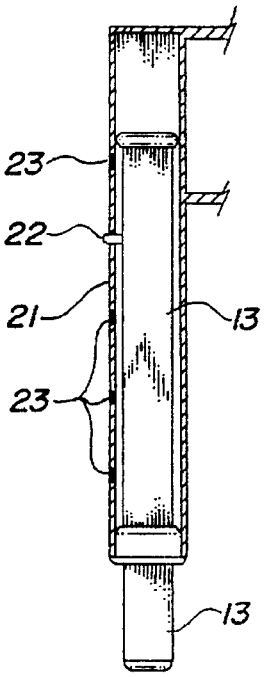

COMPACT POWERED LIFT TOILET SEAT

BACKGROUND OF THE INVENTION

This invention relates to a toilet with a powered lift seat which may he used to assist a person in being raised from and seated on the toilet.

The concept of a powered lift toilet has been disclosed in a number of variant designs. For example, U.S. Pat. No. 4,587,678 issued to Love, et al. on May 13, 1986 for "Toilet Seat Booster" discloses a stationary frame with fixed handrails. A seat assembly is pivotally coupled to the stationary frame and a ball screw motor and lift arm are provided for pivotally moving the seat frame assembly relative to the stationary frame. While most toilet seats incorporate some form of pivoting seat assembly, U.S. Pat. No. 3,925,833 issued to Hunter on Dec. 16, 1977 for "Portable Electric Hydraulic Johnny Aid" discloses a vertically movable toilet seat. Hunter employs a hydraulic cylinder for raising and lowering the seat as opposed to the electric motor of Love.

Another version of an electrically operated toilet seat is disclosed in U.S. Pat. No. 5,155,873 issued to Bridges on Oct. 20, 1992 for "Electrically Operated Lift Stool." Bridges discloses armrests which may he swung out of the way to enable an attendant to assist a disabled person in using the device. Another form of hydraulically powered lift seat is disclosed in U.S. Pat. No. 4,993,085 issued to Gibbons on Feb. 19, 1991 for "Power Assisted Toilet Seat." Gibbons discloses a pair of hydraulically operated lift assemblies with associated armrests which are tilted so as to cause the armrests to move in an upward and forward position as the mechanism is operated. The seat is provided with a second pair of hydraulically operated lifts in order to tilt the seat up and forward as the lift assemblies are operated.

The mechanical linkages allowing a powered lift seat to tilt while moving upward and forward is the subject of the disclosure of U.S. Pat. No. 4,581,778 issued to Pontoppidan on Apr. 15, 1986 for "Mechanism for Raising and Lowering a Seat Especially Designed for Handicapped Persons." Pontoppidan discloses a mechanism comprising two supporting arms which are both at one of their ends coupled to the seat and cooperate at their other end with a fixed point and driving member to provide the correct motion.

SUMMARY OF THE INVENTION

In order to function effectively and safely for its intended purpose, a powered lift toilet seat should provide stable and secure support for the patient and should further mimic, to the extent possible, the natural motion of the human body in raising itself from and lowering itself to a seated position. The prior art powered lift toilet seats have concentrated on providing the proper motion of the toilet seat. The necessary motion is, however, a complicated mixture of several trajectories. The optimum motion for the seat is to provide for the seat to both lift and move forward slightly while it is being rotated into approximately a 45° angle.

The present invention provides for a powered lifting mechanism to assist invalid patients in using a toilet by providing a mechanism which will assist them in rising from or being seated upon a toilet. In order to accomplish this function, the seat must be moved in a precise fashion which duplicates as nearly as possible the physical limitations and motions of the human body. The toilet seat must be lifted in a generally upward direction while it is being tilted forwardly and moved forwardly in the same time. Thus, the invention must accomplish three separate motions (1) vertical translation, (2) horizontal translation, and (3) rotation.

In the present invention these motions are accomplished by two separate linkage mechanisms, each of which are powered by a single linear actuator which is powered by a motor. While the prior art has attempted to address the complex superimposed motions required to duplicate the motions of the human body, the result has been complicated, bulky contrivances that have been intended primarily for use in an institutional setting. The present invention is directed to a mechanism that is simple and compact for use even in the home environment.

The front of the toilet seat is attached to a sun and planet gear mechanism. The planet gear is attached to the front underside of the toilet seat. The sun gear is attached to the planetary gear by a link. The sun gear is provided with an offset point of rotation which provides a radius of motion for the sun gear which is larger than the radius of the teeth of the sun gear. This point of rotation is located on the supporting frame work. Rotation of the sun gear in a cam-like fashion causes the front of the seat to rise and to move forward. The motion of the sun gear is effected by a linear actuator.

The linear actuator is also connected to the short end of a triangular lever which is pivotally connected to a connecting rod which in turn is pivotally connected to a point on the rear of the toilet seat. Extension of the linear actuator causes the triangular lever to rotate which in turn causes the rear of the seat through the action of the connecting rod to rise in a vertical direction. Since the seat is constrained from pure vertical movement by its connection to the sun and planet gear the net effect is to cause the rear of the seat to rise vertically to a greater degree than the front of the seat and to cause the entire seat to rotate in a forward direction. Reversal of the linear actuator causes the described sequence of motions to be reversed.

The linear actuator may be of any suitable type including hydraulic and electro-mechanical.

It is accordingly an object of the present invention to provide for a powered lift toilet seat in which the seat is provided with the optimum motion matched to the natural motions of the human body in seating itself and rising from a seated position.

It is further object of the present invention to provide for a powered lift toilet seat in which the toilet seat is provided with three motions simultaneously through a mechanism that is compact, simple, rugged, safe, and inexpensive.

Other objects and advantages of the present invention will subsequently become apparent from the detailed description of the preferred embodiment and appended claims with reference to the accompanying drawings.

BRIEF DESCRIPTION OF THE DRAWINGS

FIG. 13 is a partial sectional view of the arm mechanism which allows articulation of the arms.

FIG. 14 is a sectional view of a leg showing the height adjustment mechanism.

DETAILED DESCRIPTION OF THE PREFERRED EMBODIMENTS

Figure 2:
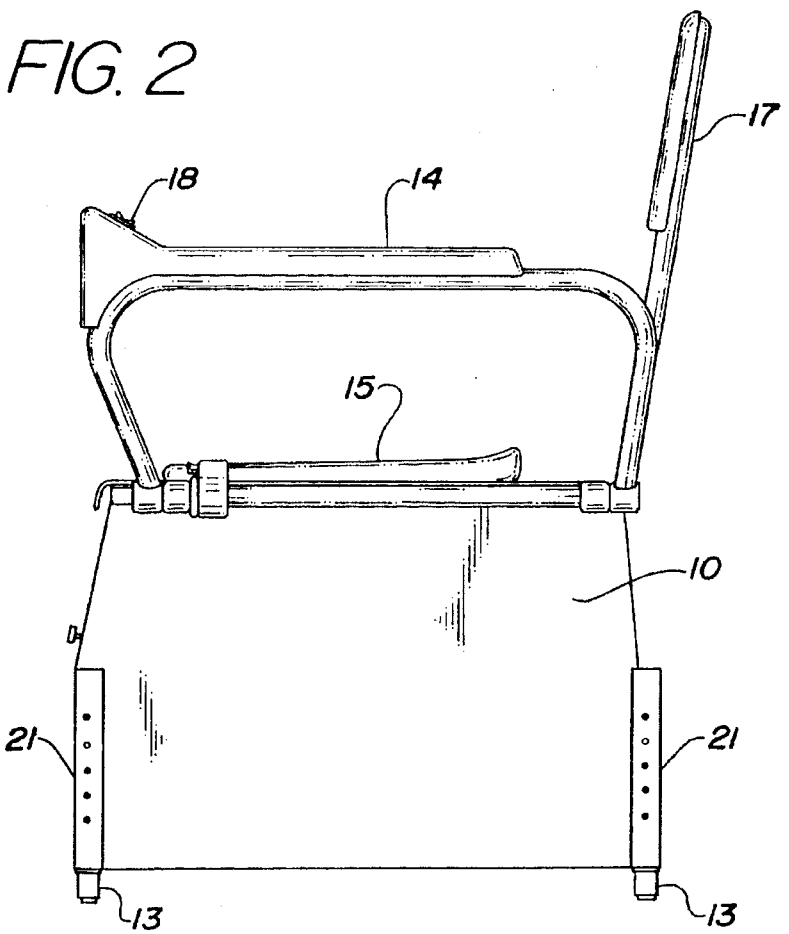
FIG. 2 is a side elevation.
Figure 1:
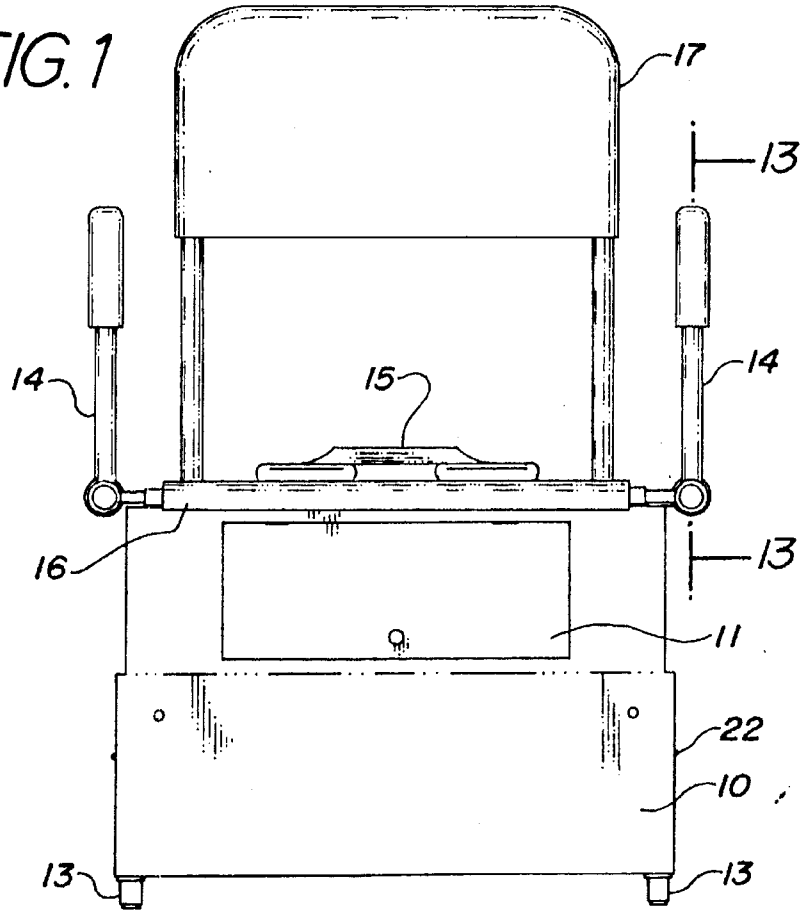
FIG. 1 is a front elevation of the powered lift toilet.
Figure 3:
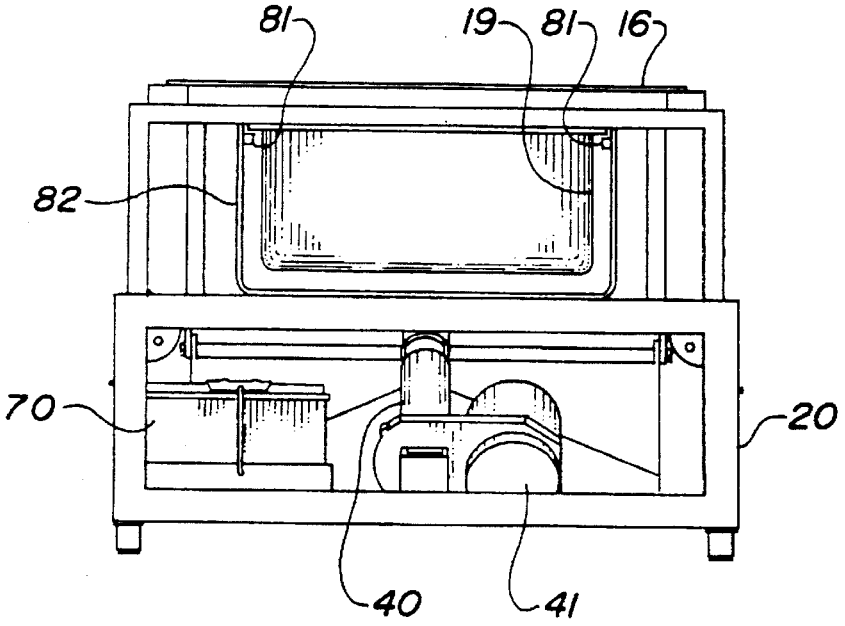
FIG. 3 is a front elevation of the toilet in the lowered position with the case removed and the arms removed for clarity.
Figure 4:
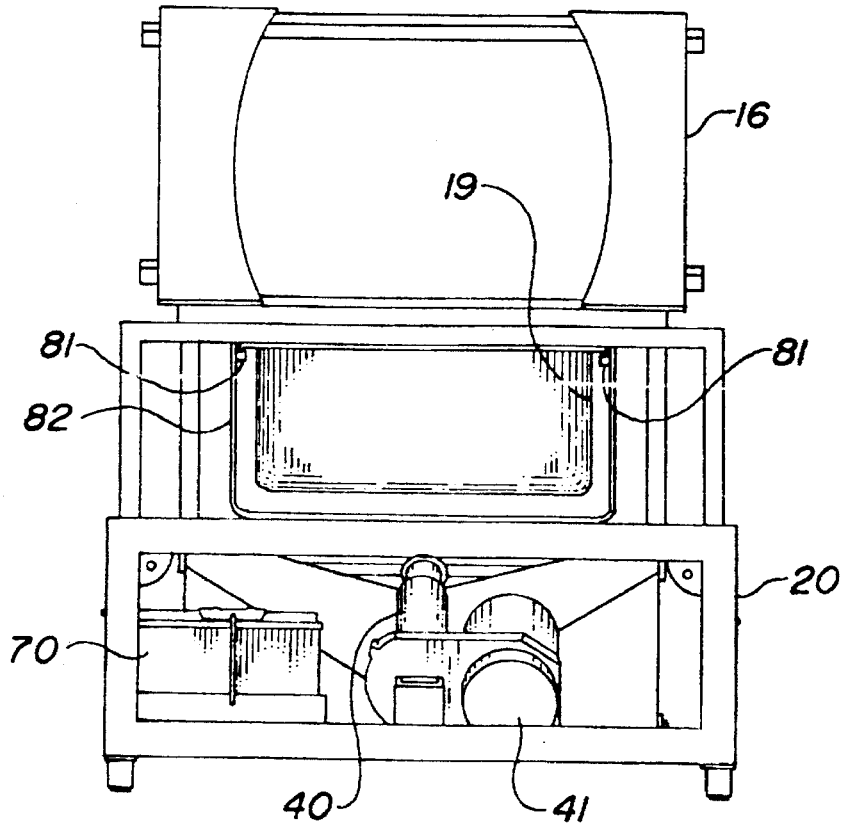
FIG. 4 is a front elevation of the toilet in the raised position with the case removed and the arms removed for clarity.

The disclosed invention is a powered lift toilet seat as illustrated on the attached drawing figures. FIGS. 1 and 2 show the complete compact powered lift toilet of the present invention. Both are shown with the case 10 in position. The case 10 provides protection to the internal mechanical components of the toilet. It also provides a safety benefit in that it prevents the mechanical components from being easily accessible to a user. In addition the case 10 serves as a splash guard. An access door 11 allows the insertion and removal of a receptacle 19 for receiving waste matter. The receptacle 19 is shown in place in FIGS. 3, 4, 7, 8, and 9. The receptacle 19 is supported on a pair of slides 81. Further, a splash shield 82 surrounds the receptacle 19 for the protection and cleanliness of the mechanical components located below the receptacle 19. The receptacle may be removed through the access door 11 or through the open back of the case 10 for cleaning.

The other major components of the toilet shown in FIGS. 1 and 2 are the adjustable legs 13, which will be described more fully hereinafter, the articulated arms 14 which may be swung out of the way of the user or an attendant in a fashion which will be described hereinafter, the seat 15 supported on the seat support 16, and the backrest 17. The seat 15 is a molded article which removably fits into and is supported by the seat support 16.

The operation of the powered lift seat may be accomplished by a remote switch controlled by an attendant or by the user through a switch 18 mounted on one of the arms 14.

Figure 11:
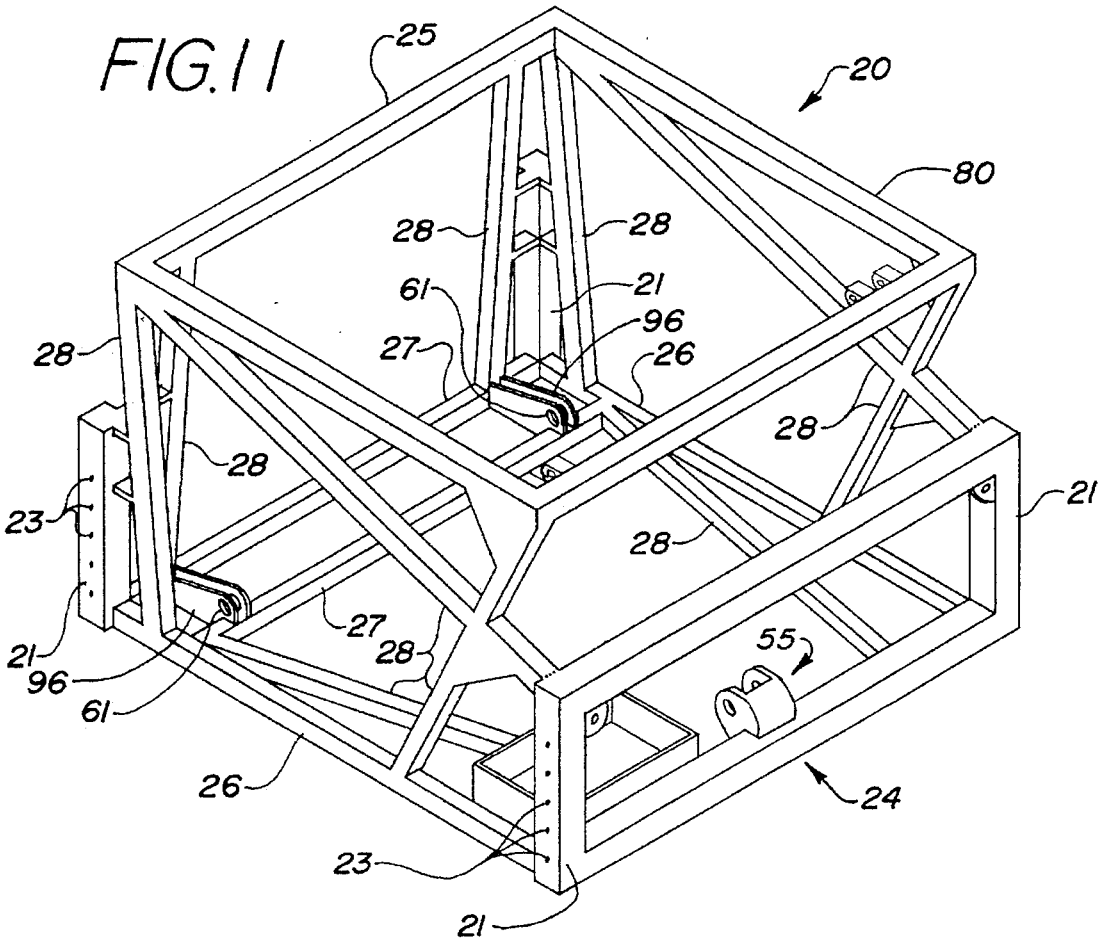
FIG. 11 is a perspective view of the frame.

The toilet of the present invention is based around a ruggedly built frame 20 as shown in. FIG. 11. The frame 20 provides a skeleton to which the other main components of the toilet are attached. The frame 20 includes leg support receptacles 21 for slidably receiving the legs 13. The legs 13 are height adjustable as shown in FIG. 14. The legs 13 are slidably received in the leg support receptacles 21. A spring loaded detent 22 on each leg 13 engages one of a series of holes 23 in the leg support receptacles 21. The height of each leg may thereby be set depending on which on the series of holes 23 engages the detent 22.

The frame 20 also comprises structural supports for bracing the frame 20 against all mechanical loads. The structural supports include a front box frame 24 which incorporates two front leg support receptacles 21, and a top box frame 25 for carrying the seat support 16. These structural members, the front box frame 24 and the top box frame 25, are braced and supported by longitudinal structural members 26, transverse structural members 27, and diagonal braces 28. Together, the described structural components constitute the frame 20. The frame 20 provides points of attachment for various other components of the toilet.

Figure 10:
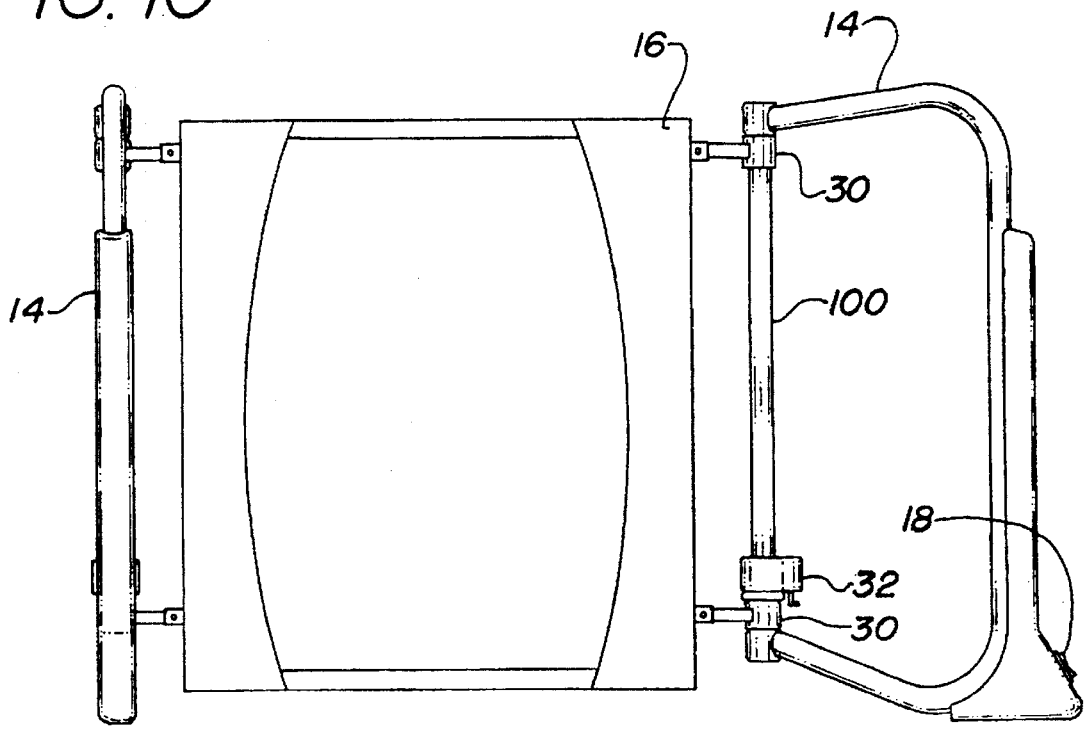
FIG. 10 is a top view of the seat support with the seat removed showing articulation of the arms.

The arms 14 may be swung to one side and out of the way of attendants and users. This may be desirable in assisting an invalid or disabled person to whom any sort of obstacle may represent a severe impediment. The operation of the articulated arms may be described with reference to FIGS. 10 and 13. Each arm 14 has a horizontal member 100 which is rotatably received in a pair of mounting sleeves 30 which are affixed to either side of the frame 20. The arms are then capable of moving rotatably between an upright position to an outward position. Both positions are illustrated in FIG. 10. In the upright position, the arms 14 are deployed to assist the user in seating upon the toilet and rising therefrom. In the outward position, the arms 14 are deployed away from the user for maximum access by an attendant and minimum interference with the user. The arms are locked in various positions by a locking mechanism 31 shown in FIG. 13. As described, the horizontal member 100 of the arm 14 freely rotates within the mounting sleeves 30. A locking bracket 32 containing a spring loaded locking lever 33 is rigidly affixed to the arm 14. The locking lever moves a locking pin 34 into and out of engagement with a plurality of engagement holes 35 provided on one of the mounting sleeves 30. Each arm 14 may thereby be locked into various position from fully upright to horizontally outward to fully downward.

The present invention must accomplish three separate motions: (1) vertical translation, (2) horizontal translation, and (3) rotation. As shown with reference to FIGS. 5 and 6, these motions are accomplished by two separate linkage mechanisms, both of which are put into motion by a single linear actuator 40 which is powered by a motor 41. Each of these linkage mechanisms will be described separately.

Figure 5:
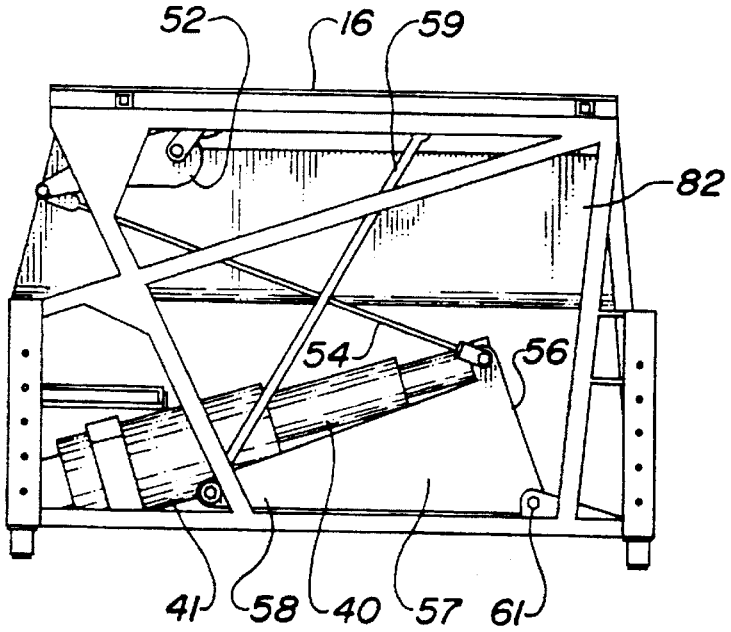
FIG. 5 is a side elevation of the toilet in the lowered positions with the case removed and the arms removed for clarity.
Figure 6:
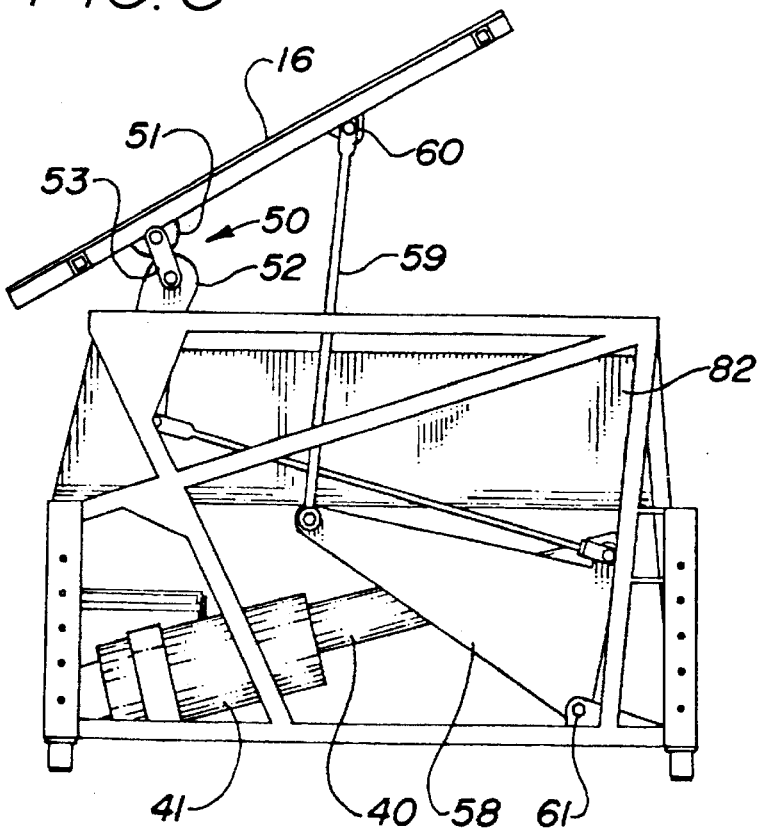
FIG. 6 is a side elevation of the toilet in the raised position with the case removed and the arms removed for clarity.
Figure 7:
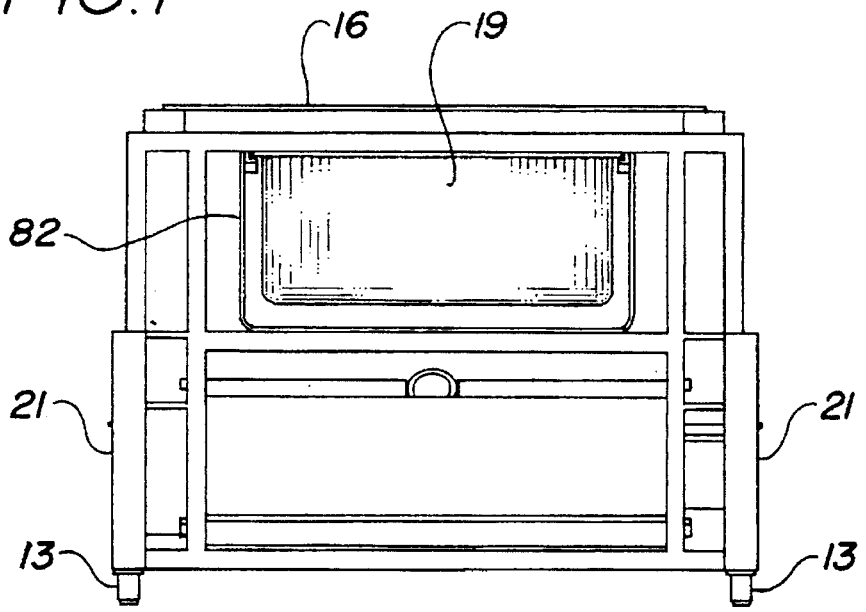
FIG. 7 is a rear elevation of the toilet in the lowered position with the case removed and the arms removed for clarity.
Figure 8:
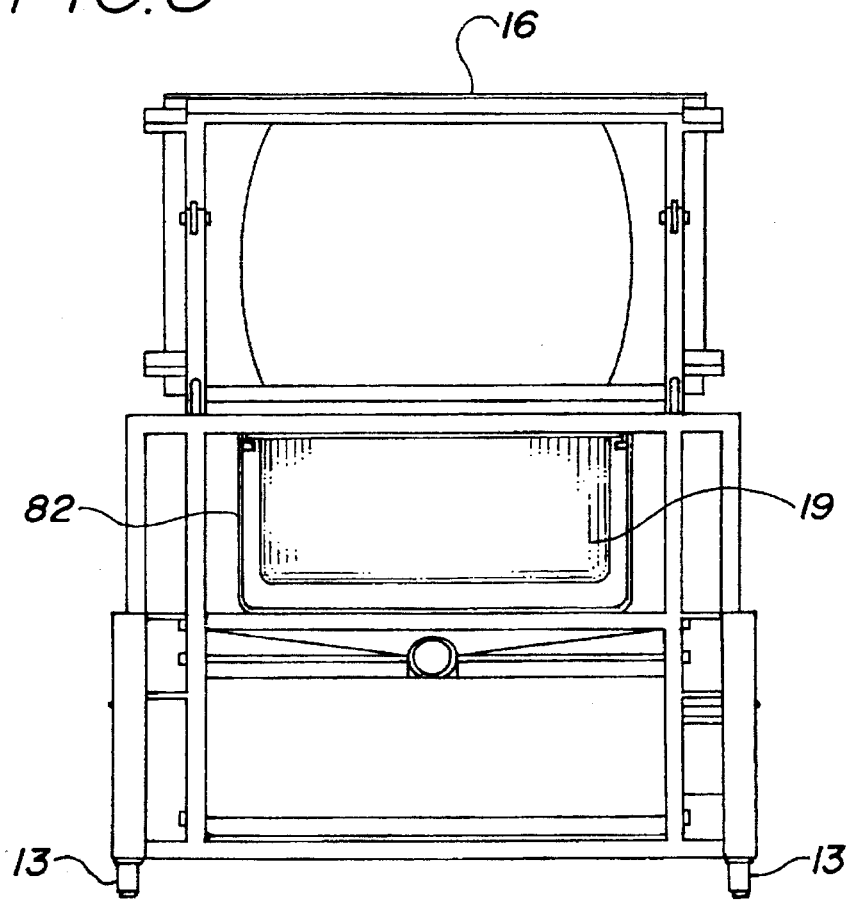
FIG. 8 is a rear elevation of the toilet in the raised position with the case removed and the arms removed for clarity.
Figure 9:
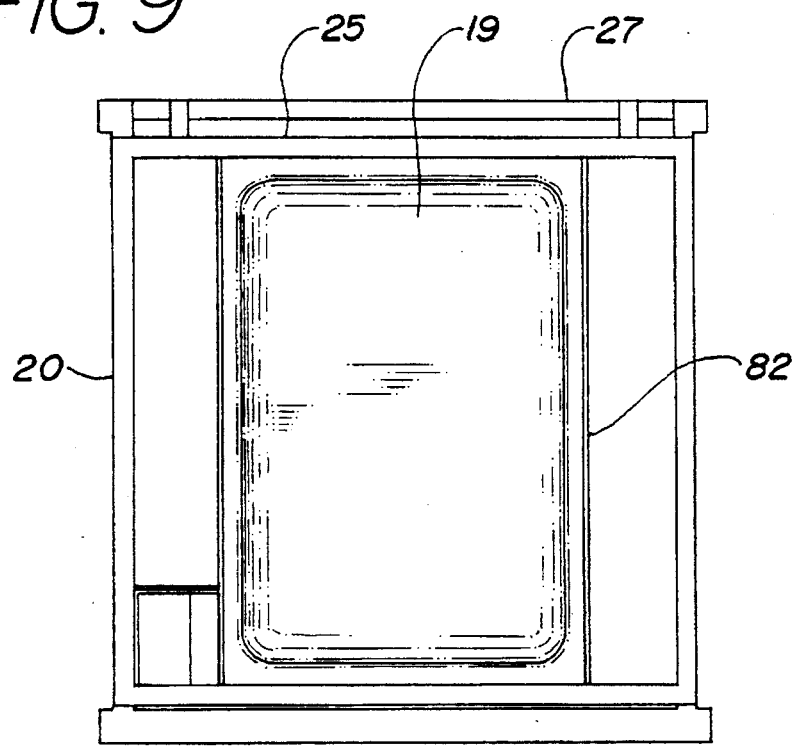
FIG. 9 is a top view with the case and seat support removed showing the receptacle in place within the frame
Figure 12:
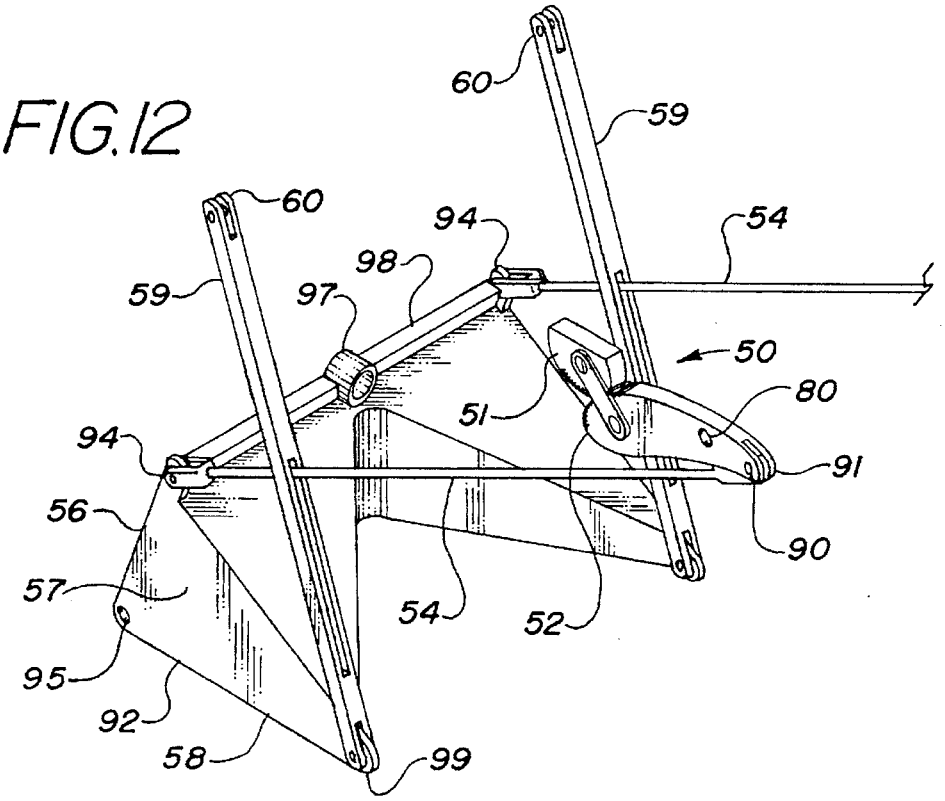
FIG. 12 is a perspective view of the lift mechanism with the frame and case removed for clarity.

Referring to FIGS. 5, 6, and 11, the front of the seat support 16 is attached to a sun and planet gear mechanism 50. A sun and planet gear mechanism 50 is located on each side of the toilet. The planet gear 51 is attached to the front underside of the seat support 16. The sun gear 52 is attached to the planetary gear by a link 53. The sun gear 52 is provided with a point of rotation 80 on the frame (hidden by the frame 20 and not shown in FIGS. 5 and 6; however, see FIG. 11) which provides a radius of rotation for the sun gear 52 which is larger than the radius characterizing the teeth of the sun gear 52. This point of rotation is located on the frame 20. The sun gear 52 is elongated in a tear-drop shape. The sun gear 52 is provided with a pivotal connection point 90 at the narrow end 91 of the sun gear 52 opposite to the planet gear 51 for connection to a connecting rod 54. The sun gear 52 is rotated in a cam-like fashion through the action of the connecting rod 54. With particular reference to FIG. 12, the connecting rod 54 is attached pivotally to a yoke 92 at a point 94. The yoke 92 is pivotally attached to the frame 20 at an offset point 95 to a bracket 96. The yoke 92 is pivotally attached to the linear actuator 40 at an actuator bracket 97. The actuator bracket 97 is attached to an axle (hidden within a bracket assembly 98) which is free to pivot about the points 94. As the linear actuator 40 extends, the connecting rod 54 acts on the sun gear 52 which through its action on the planetary gear 51 causes the seat support 16 to rise vertically and to move forward. Reversal of the linear actuator 40 causes the reverse motions to occur. The linear actuator 40 and motor 41 are pivotally mounted to a linear actuator motor bracket 55 on the frame 20 as shown in FIG. 11.

The yoke 92 effectively forms a three point, triangular lever 57 defined by the points 94, 95 and a third point 99 which is pivotally connected to a second connecting rod 59. The linear actuator 40 is connected to the short arm 56 of the three point, triangular lever 57. The long arm 58 of the triangular lever 57 is pivotally connected to the second connecting rod 59 which in turn is pivotally connected to a point 60 on the rear of the seat support 16. Extension of the linear actuator 40 causes the triangular lever 57 to rotate about a point 61 on the rear of the frame 20 which in turn causes the rear of the seat support 16 through the action of the second connecting rod 59 to rise in a vertical direction. Since the seat support 16 is constrained from pure vertical movement by its connection to the sun and planet gear 50 the net effect is to cause the rear of the seat support 16 to rise vertically to a greater degree than the front of the seat support 16 and to cause the entire seat support 16 to rotate in a forward direction. Reversal of the linear actuator 40 causes the described sequence of motions to be reversed. The present invention is shown in the raised position in FIGS. 4, 6, and 8, and in the lowered position in FIGS. 3, 5, and 7.

The linear actuator 40 may be of any suitable type including hydraulic and electro-mechanical. A battery 70 may be employed to provide electrical power to the linear actuator 40 and motor 41 to provide for portability. Power may also be provided from wall outlets.

While the present invention has been described with respect to certain preferred and alternative embodiments, such are exemplary and not intended as limiting. A person skilled in the art would recognize that modifications to the embodiments described herein could be made without departing from the spirit and scope of the invention as set forth in the appended claims.

What is claimed is:

1. A powered lift toilet, comprising:

a toilet seat having a frontward portion and a rearward portion;

a frame for supporting said toilet seat in an appropriate position for use by a user;

cam means having first and second ends and having a pivot point therebetween for rotation about said pivot point in a vertical plane, said pivot point located at an upper front edge of said support frame;

a sun and planet gear set having a sun gear center of rotation and a planet gear center of rotation;

said sun gear being affixed to said second end of said cam means;

said planet gear being affixed to a front underside of said toilet seat;

means attached to said first end of said cam means for rotating said cam means about said pivot point; and means attached to a rearward point of said toilet seat for raising said rearward point of said toilet seat simultaneously with rotation of said cam means, whereby said toilet seat is moved upward and forward while simultaneously said toilet seat is revolved forwardly such that said rearward point of said toilet seat is moved upward and forward relative to the frontward portion.

* * * * *